US005112651A

United States Patent [19]

Watanabe et al.

[11] Patent Number: 5,112,651

[45] Date of Patent: May 12, 1992

[54] METHOD AND APPARATUS AN IMAGE-RECEIVING ELEMENT IN DIFFUSION TRANSFER PHOTOGRAPHY INCLUDING DRYING AND HEATING STAGES

[75] Inventors: Toshihiro Watanabe; Masashi Ishiyama; Noriaki Masuda, all of Kanagawa, Japan

[73] Assignee: Fuji Photo Film Co., Ltd., Kanagawa, Japan

[21] Appl. No.: 433,232

[22] Filed: Nov. 8, 1989

[30] Foreign Application Priority Data

Nov. 9, 1988 [JP] Japan ..... 63-283125

[51] Int. Cl.[5] ..... B05D 3/04

[52] U.S. Cl. ..... 427/339; 427/340; 427/378; 427/379; 430/232

[58] Field of Search ..... 427/382, 340, 335, 337, 427/412.2, 378, 339, 379; 430/232

[56] References Cited

U.S. PATENT DOCUMENTS

| | | | |
|---|---|---|---|
| 2,760,884 | 8/1956 | Graf, Jr. | 427/382 |
| 2,769,722 | 11/1956 | Converse | 427/277 |
| 2,838,420 | 6/1958 | Valente | 427/378 |
| 3,078,178 | 2/1963 | Ostberg et al. | 430/531 |
| 3,607,269 | 9/1971 | Young | 430/232 |
| 3,772,025 | 11/1973 | Land | 430/232 |
| 3,928,665 | 12/1975 | Land | 427/339 |
| 3,969,541 | 7/1976 | Mukaida et al. | 430/232 |
| 4,336,279 | 6/1982 | Metzger | 427/382 |
| 4,569,899 | 2/1986 | Inagaki et al. | 430/232 |
| 4,629,677 | 12/1986 | Katoh | 430/215 |
| 4,717,642 | 1/1988 | Watanabe et al. | 427/333 |

FOREIGN PATENT DOCUMENTS

| | | |
|---|---|---|
| 2241401 | 8/1971 | Fed. Rep. of Germany . |
| 2256047 | 11/1972 | Fed. Rep. of Germany . |

OTHER PUBLICATIONS

Patent Abstracts of Japan, vol. 7, No. 266 (P-239) (1411), Nov. 26, 1983 & JPA-58-147737, Sep. 2, 1983.

*Primary Examiner*—Michael Lusignan
*Assistant Examiner*—Diana L. Dudash
*Attorney, Agent, or Firm*—Sughrue, Mion, Zinn, Macpeak & Seas

[57] ABSTRACT

A method of forming a silver image receiving element in diffusion transfer photography by hydrolyzing a surface of an alkali-impermeable polymer layer on a continuous running web so as to convert the polymer to an alkali-permeable polymer. The method includes the steps of first applying a liquid mixture of a hydrolyzing agent and a softening agent to the surface of the alkali-impermeable polymer layer, evaporating the softening agent in the liquid mixture by blowing air on the surface to form a concentrated layer of the hydrolyzing agent; and thereafter accelerating the occurrence of hydrolysis by blowing air on the surface so as to initiate hydrolysis reaction of the surface to as to convert the alkali-impermeable polymer layer to an alkali-permeable polymer layer. The temperature of the air which is blown on the surface is in the range of 50° to 120° C.

16 Claims, 2 Drawing Sheets

METHOD AND APPARATUS AN IMAGE-RECEIVING ELEMENT IN DIFFUSION TRANSFER PHOTOGRAPHY INCLUDING DRYING AND HEATING STAGES

BACKGROUND OF THE INVENTION

FIELD OF THE INVENTION

The present invention relates to a process for producing image-receiving elements used in diffusion transfer photographic materials. More particularly, the present invention relates to a method by which a surface of an alkali-impermeable polymer layer preliminarily formed on a continuously running web is hydrolyzed to be converted to an alkali-permeable polymer.

The term "alkali-impermeable polymer" as used herein means a polymer that remains substantially impermeable to aqueous alkalies for a predetermined period of time within which photographic processing is completed. The term "alkali-permeable polymer" as used herein means a polymer that is reasonably permeable to aqueous alkalies for a predetermined period of time during which an internal phase material is allowed to take part in the process of image formation. In a preferred embodiment of the present invention as it is applied to the field of its intended use, an image is formed in a layer of the alkali-permeable polymer.

The term "softening agent" as used herein means a solvent that swells the alkali-impermeable polymer layer, thereby assisting the hydrolyzing agent to penetrate into the layer.

BACKGROUND

Techniques of hydrolyzing the layer of an alkali-impermeable polymer on a support to convert its surface area to an alkali-permeable polymer, thereby forming a diffusion transfer photographic image-receiving element are described in U.S. Pat. No. 3,772,025 and U.S. Pat. No. 3,671,241. However, these patents do not show how to perform hydrolysis in order to form a smooth-surfaced image-receiving element.

A hydrolysis method is shown in U.S. Pat. No. 3,078,178. The method comprises the step of supplying a hydrolyzing agent to the surface of an acetyl cellulose layer and immediately thereafter, pressing the acetyl cellulose layer onto the smooth surface of a heating drum, thereby hydrolyzing the surface area or the acetyl cellulose layer to be converted to alkali-permeable cellulose. In this method, the layer of alkali-impermeable polymer is pressed onto the drum after the surface area of the polymer has become completely soft, so any flaws or undulations on the drum surface are readily transferred onto the polymer surface and it cannot be provided with a desired smoothness unless strict maintenance and control is performed on the drum surface to maintain a smooth and glossy state.

SUMMARY OF THE INVENTION

An object, therefore, of the present invention is to provide a method by which a surface of an alkali-impermeable polymer layer is hydrolyzed to convert the polymer to an alkali-permeable polymer, thus obtaining diffusion transfer photographic image-receiving element without involving any of the difficulties previously encountered in the maintenance and control of a drum surface and without impairing the smoothness of the polymer surface.

The above-stated object of the present invention can be attained by a method which forms a silver image-receiving element in diffusion transfer photography by hydrolyzing a surface of an alkali-impermeable polymer on a continuously running web so as to convert the polymer to an alkali-permeable polymer, which method comprises the steps of applying a liquid mixture of a hydrolyzing agent and a softening agent to the surface of said alkali-impermeable polymer layer, evaporating the softening agent in said liquid mixture by means of a drying apparatus which does not contact the surface of said layer, and then accelerating the occurrence of hydrolysis by means of a heating apparatus which does not contact the surface of said layer.

DETAILED DESCRIPTION OF THE INVENTION

An embodiment of the present invention is described hereinafter with reference to the accompanying drawings.

Figure 1:
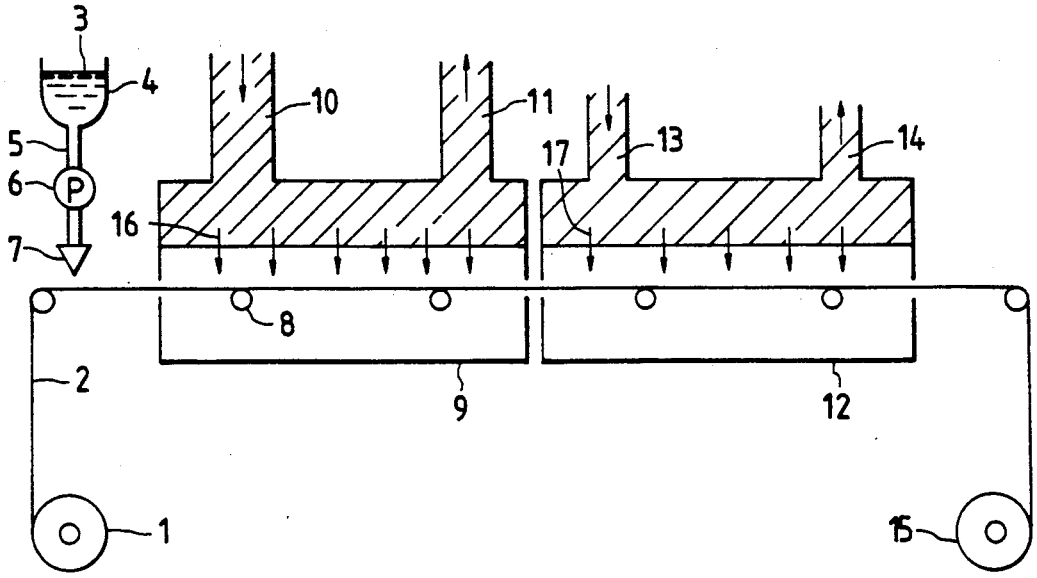
FIG. 1 shows an embodiment of the present invention.

As shown in FIG. 1, a web 2 having a layer of alkali-impermeable polymer formed on its surface is continuously unwound from a supply roll 1 by means of a drive unit (not shown). With its back side being supported by pass rollers 8, the web 2 travels successively through a coating zone 7, a drying apparatus 9 and a heating apparatus 12 and is wound onto a takeup roll 15. The layout of the system shown in FIG. 1 is so designed that the web 2 can be transported without making contact with the coated surface.

In the coating zone 7, a liquid mixture 3 consisting of a hydrolyzing agent and a softening agent in a feed vessel 4 is coated continuously onto the web via a pipe 5 and a metering pump 6. The drying apparatus 9 is equipped with a drying air supply duct 10 and a drying air exhaust duct 11 and supplies drying air 16 from an air source (not shown). In a similar way, the heating apparatus 12 is equipped with a heating air supply duct 13 and a heating air exhaust duct 14 and heating air 17 is supplied from an air source.

The surface of the web 2 having a layer of alkali-impermeable polymer formed on its surface is coated in the coating zone 7 with the liquid mixture 3 consisting of a hydrolyzing agent and a softening agent. The softening agent swells a near-surface area of the layer of alkali-impermeable polymer, thereby assisting in the penetration of the hydrolyzing agent into that layer.

In the drying apparatus 9, the greater part of the softening agent in the liquid mixture 3 evaporates to form a concentrated layer of the hydrolyzing agent on the surface of the layer of alkali-impermeable polymer.

The web 2 then enters the heating apparatus 12, where it is heated with hot air to initiate hydrolysis reaction in the area where the hydrolyzing agent is present. At this stage, there is a certain amount of softening agent left intact and the hydrolyzing agent continues to penetrate the polymer layer. As the residual amount of softening agent decreases and the rate of its evaporation reduces, the temperature of the web 2 rises sharply to accelerate the hydrolysis of the polymer. As a result of this reaction, at least the surface of the layer of alkali-impermeable polymer is converted to an alkali-permeable polymer. When all of the softening agent is evaporated, the movement of hydrolyzing agent through the polymer layer ceases and the hydrolysis reaction is terminated since there is no further penetration of the hydrolyzing agent. The surface temperature of the web levels off at the temperature of the heating air and becomes constant.

The pathway of the web 2 travelling through the drying apparatus 9 and the heating apparatus 12 is so designed that it can be transported without contacting the coated surface. This is effective in permitting the web 2 to reach the takeup roll 15 without any damage to the smoothness of the surface on which an image-receiving element is to be formed.

The effective temperature range for the drying air 16 and heating air 17 is from 50° to 120° C. In order to minimize the thickness of the layer which undergoes conversion to an alkali-permeable polymer, temperatures above 80° C. are preferred. On the other hand, if one wants to prevent thermal deformation of the web, temperatures below 100° C. are preferred. Since the relationship between the rate and temperature of reaction is governed by the well known Arrhenius' equation:

$$K = KoE\ exp(-E/RT)$$

(where Ko is the frequency factor; E is the activation energy; R is the gas constant; and T is the absolute temperature), the rate of hydrolysis reaction can be varied by selecting appropriate conditions for each of the drying air 16 and heating air 17, and allowing for control of the thickness of the layer which is to be converted to an alkali-permeable polymer.

Illustrative alkali-impermeable polymeric materials that can be used in the present invention are cellulose esters such as cellulose diacetate and cellulose triacetate.

Useful hydrolyzing agents include hydroxides of alkali metals such as sodium hydroxide and potassium hydroxide.

Useful softening agents include lower alcohols such as methanol and ethanol, which may be mixed with (no more than 50 vol %) of water.

Further, the method of controlling the rate of hydrolysis reaction by adding a polyhydric alcohol ($OH \geqq 2$) or a derivative thereof as shown in Unexamined Published Japanese Patent Application No. 63-47757 may be employed in combination with the above method of selecting proper conditions for both the drying air 16 and heating air 17.

The mechanism of the coating zone 7 is not limited to any particular type and any of the known systems such as slide coating (U.S. Pat. No. 2,761,791), curtain coating (U.S. Pat. No. 3,508,947) and extrusion coating (U.S. Pat. No. 3,526,528) may be adopted.

Besides atmospheric air, nitrogen gas may be used as the drying air and heating air. Other heating media such as radiation heat may be used as long as they permit non-contact drying or heating.

The drying apparatus may be the same as the heating apparatus in construction. The difference between them resides in that the drying apparatus is provided mainly for assisting the penetration of the hydrolyzing agent into the layer of alkali-impermeable polymer whereas the heating device is provided for causing hydrolysis reaction. Thus, the drying apparatus is distinguishable from the heating apparatus in view of the differences of process and effect. However, the drying air may have the substantial same conditions as the heating air.

The following examples are provided for the purpose of further illustrating the present invention but are in no way to be taken as limiting.

EXAMPLE 1

The web 2 consisted of an alkali-impermeable polymer layer (cellulose diacetate) about 8 μm thick and an overlying layer about 1.5 μm thick that contained palladium sulfide as a silver precipitant.

The liquid mixture 3 was prepared by mixing 3 g of sodium hydroxide (hydrolyzing agent), 100 cc of methanol (softening agent), and 8 g of glycerin as a polyhydric alcohol ($OH = 3$) for controlling the rate of hydrolysis reaction.

This liquid mixture 3 was applied to the web 2 in a coating volume of 22 $cc/m^2$ and fed into the drying apparatus 9 about 3 seconds later. The web was dried with drying air (95° C.) for about 5 seconds with the air flow rate on the web surface being controlled at 0.5–1.0 m/sec.

Under the same conditions as in the drying zone, the web was subsequently heated for about 40 seconds.

Figure 2:
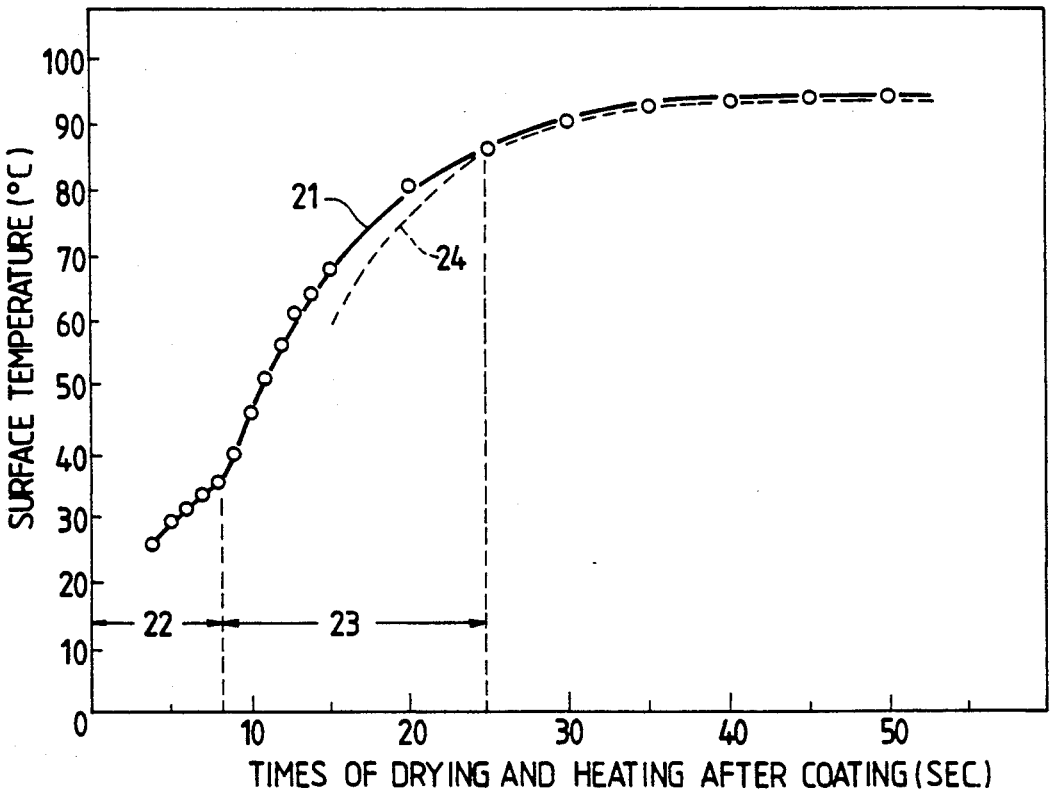
FIG. 2 shows the temperature profile of a web having an alkali-impermeable polymer layer.

FIG. 2 shows the temperature profile of the web surface as it was held in the drying apparatus 9 and heating apparatus 12. The horizontal axis of the graph in FIG. 2 plots the lapse of time after the liquid mixture 3 was coated onto the web. The period indicated by 22 is the duration of time for which the web stayed in the drying apparatus 9. In this period, the liquid mixture 3 penetrated into the cellulose diacetate layer while the greater part of methanol as the softening agent evaporated. The web surface did not experience any significant increase in temperature. The period indicted by 23 corresponds to the stage at which the web 2 in the heating apparatus 12 underwent progressive hydrolysis reaction. As the residual amount of methanol decreased and the rate of its evaporation became low, the temperature of the web surface rose sharply to accelerate the progress of its hydrolysis. When all of the methanol had been evaporated, the movement of the hydrolyzing agent through the layer ceased and the hydrolysis reaction was terminated since there was no additional supply of the hydrolyzing agent. The surface temperature of the web leveled off at the temperature of the heating air and became constant.

As a result, a uniform layer of alkali-permeable cellulose formed in a thickness of about 2 μm on the web surface without impairing its gloss. Further, the web surface did not have any undulations due to heat.

EXAMPLE 2

An experiment was conducted with the web 2 (comprising a layer of alkali-impermeable polymer) and the liquid mixture 3 (containing a hydrolyzing agent, a softening agent and a reaction control agent) being both the same as those used in Example 1. In this experiment, however, the drying and heating conditions were varied at three different levels.

Figure 3:
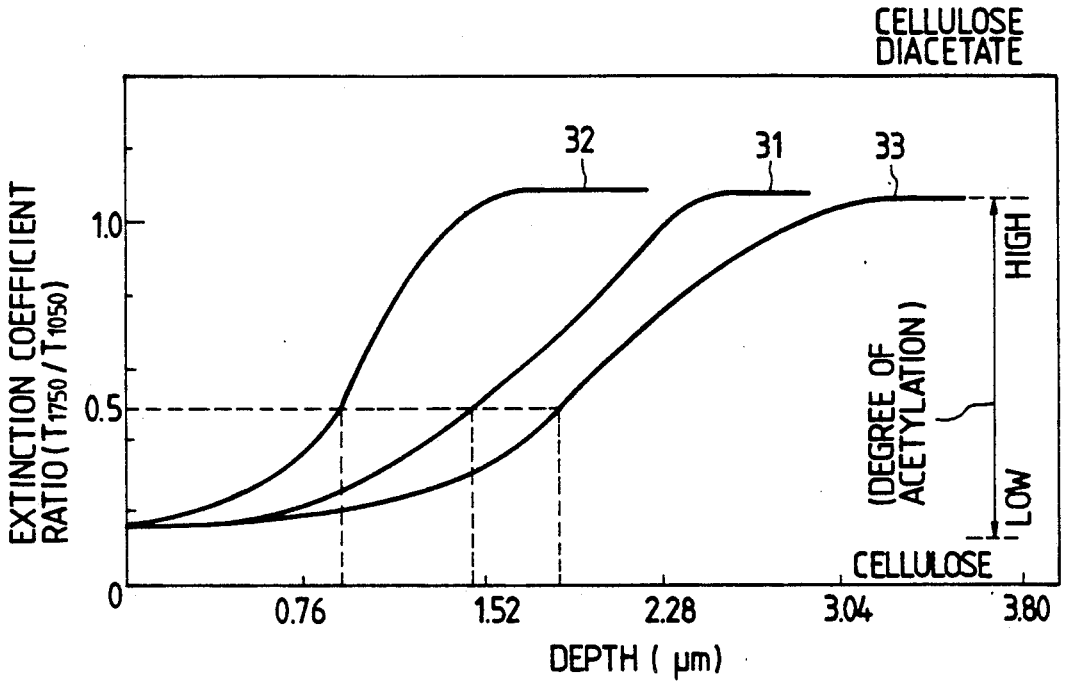
FIG. 3 is a graph showing the relationship between the drying/heating conditions and the conversion density.

FIG. 3 shows how the depth by which the surface of cellulose diacetate layer was converted to cellulose varied depending upon the drying and heating conditions employed. The horizontal axis of the graph in FIG. 3 plots the depth from the surface of cellulose diacetate layer, and the vertical axis plots the conversion density as determined from microscopic infrared absorption data. The term "conversion density" as used herein means the degree of cellulose diacetate to cellulose conversion as achieved by hydrolysis. This parameter is expressed by $T_{1750}/T_{1050}$ where $T_{1750}$ and $T_{1050}$ are the extinction coefficients measured by microscopic infrared spectroscopy.

As FIG. 3 shows, the cellulose diacetate layer was converted to cellulose almost completely (low degree of acetylation) in the area near to its surface but as the depth of conversion site increased, the conversion density decreased gradually (the degree or acetylation increased) until it became almost zero at a certain depth.

Curve 31 in FIG. 3 represents the results of the case where the temperature of drying air was 100°.C., drying air flow rate was 2–4 m/sec, and the temperature of heating air was 100° C.; curve 32 represents the results of the case where the respective parameters were 120° C., 6–7 m/sec, and 120° C.; and curve 33 represents the results of the case for 50° C., 0.5–1 m/sec and 50° C. The flow rate of heating air was varied from 0.5 to 7 m/sec but no significant change occurred.

Under all of the conditions tested, a uniform alkaline-permeable cellulose layer was formed without experiencing any loss in the surface gloss.

Further, it is worth noting that the depth of conversion to cellulose in the direction of layer thickness could be controlled by properly selecting the drying and heating conditions. If the depth of the point of $T_{1750}/T_{1050}=0.5$ (see FIG. 3) from the surface is taken as the thickness (t) of the layer in which cellulose diacetate was converted to cellulose, t is about 1.5 μm under the medium conditions shown by curve 31, whereas t is about 0.9 μm and the change of $T_{1750}/T_{1050}$ in the direction of layer thickness is abrupt under the enhanced drying and heating conditions shown by curve 32. In contrast, t increases to about 1.8 μm and the change of $T_{1750}/T_{1050}$ is slight under the attenuated drying and heating conditions shown by curve 33.

According to the present invention, a mixture of a hydrolyzing agent and a softening agent is coated onto the near-surface area of an alkaline-impermeable polymer layer, which is thereafter passed through a drying and a heating apparatus which does not contact the polymer layer, thereby allowing the softening agent to evaporate and the polymer layer to undergo hydrolysis reaction in sequential steps. As a result, a uniform alkali-permeable polymer layer can be produced without impairing its surface smoothness and without involving any difficulty in maintaining high degree of smoothness by special procedures of maintenance and control. Further, if the drying and heating conditions are properly selected, not only the thickness of the layer in which the alkali-impermeable polymer is converted to the alkali-permeable polymer but also the degree of its change can be so controlled as to produce a diffusion transfer photographic image-receiving element having desired photographic performance.

What is claimed is:

1. A method of forming a silver image receiving element in diffusion transfer photography by hydrolyzing a surface of an alkali-impermeable polymer layer on a continuously running web so as to convert said polymer to an alkali-permeable polymer, comprising the steps of:

(A) applying a liquid mixture of hydrolyzing agent and a softening agent to the surface of said alkali-impermeable polymer layer;

(B) evaporating said softening agent in said liquid mixture by blowing air on said surface so as to form a concentrated layer of said hydrolyzing agent; and thereafter (C) accelerating the occurrence of hydrolysis by blowing air on said surface so as to initiate hydrolysis reaction of said surface so as to convert said alkali-impermeable polymer layer to an alkali-permeable polymer layer.

2. The method of claim 1, wherein the temperature of said air in steps (B) and (C) is in the range of 50° to 120° C.

3. The method of claim 2, wherein the temperature of said air in steps (B) and (C) is in the range of 80° to 100° C.

4. The method of claim 1, wherein said alkali-impermeable polymer is one of a cellulose diacetate and cellulose triacetate.

5. The method of claim 1 wherein said hydrolyzing agent includes one of sodium hydroxide and potassium hydroxide.

6. The method of claim 1, wherein said softening agent includes one of methanol and ethanol.

7. The method of claim 1, wherein said liquid mixture further includes a polyhydric alcohol.

8. A method of forming a silver image receiving element in diffusion transfer photography by hydrolyzing a surface of an alkali-impermeable polymer layer on a continuously running web so as to convert said polymer to an alkali-permeable polymer, comprising the steps of:

(A) applying a liquid mixture of hydrolyzing agent and a softening agent to the surface of said alkali-impermeable polymer layer;

(B) evaporating said softening agent in said liquid mixture by performing non-contact drying of said surface in an evaporating chamber so as to form a concentrated layer of said hydrolyzing agent; and thereafter (C) accelerating the occurrence of hydrolysis by performing non-contact heating of said surface in an accelerating chamber separate from said evaporating chamber so as to initiate hydrolysis reaction of said surface so as to convert said alkali-impermeable polymer layer to an alkali-permeable polymer layer.

9. The method of claim 8, wherein said non-contact drying and heating performed in steps (B) and (C) is in the range of 50° to 120° C.

10. The method of claim 9, wherein said non-contact drying and heating performed in steps (B) and (C) is in the range of 80° to 100° C.

11. The method of claim 8, wherein said alkali-impermeable polymer is one of a cellulose diacetate and cellulose triacetate.

12. The method of claim 8, wherein said hydrolyzing agent includes one of sodium hydroxide and potassium hydroxide.

13. The method of claim 8, wherein said softening agent includes one of methanol and ethanol.

14. The method of claim 8, wherein said liquid mixture further includes a polyhydric alcohol.

15. The method of claim 8, wherein said evaporating and accelerating chambers have separate air supply ducts and separate exhaust ducts to enable independent control of said chambers.

16. The method of claim 1, wherein step (B) is performed in an evacuating chamber and step (C) is performed in an accelerating chamber separate from said evacuating chamber, said evaporating and accelerating chambers having separate air supply ducts and separate exhaust ducts.

* * * * *